US005722151A

United States Patent [19]

Pleschiutschnigg et al.

[11] Patent Number: 5,722,151

[45] Date of Patent: Mar. 3, 1998

[54] PROCESS FOR MAKING SEMI-FINISHED PRODUCTS

[75] Inventors: Fritz P. Pleschiutschnigg; Lothar Parschat; Dieter Stalleicken, all of Duisburg; Tarek El Gammal, Aachen; Michael Vonderbank, Aachen; Peter Lorenz Hamacher, Aachen; Ingo von Hagen, Krefeld; Ulrich Menne, Hattingen; Uwe Schmidt, Bochum, all of Germany

[73] Assignee: Mannesmann Aktiengesellschaft, Düsseldorf, Germany

[21] Appl. No.: 557,135

[22] PCT Filed: Jun. 3, 1994

[86] PCT No.: PCT/DE94/00656

§ 371 Date: Jan. 25, 1996

§ 102(e) Date: Jan. 25, 1996

[87] PCT Pub. No.: WO94/29048

PCT Pub. Date: Dec. 22, 1994

[30] Foreign Application Priority Data

Jun. 8, 1993 [DE] Germany ..... 43 19 569.5

[51] Int. Cl.[6] ..... F16J 15/12

[52] U.S. Cl. ..... 29/527.2; 118/68; 118/620; 427/432; 266/112

[58] Field of Search ..... 118/620, 68, 650, 118/420; 427/432; 266/104, 112

[56] References Cited

U.S. PATENT DOCUMENTS

| | | | |
|---|---|---|---|
| 3,484,280 | 12/1969 | Carreker, Jr . | |
| 3,511,686 | 5/1970 | Withrow . | |
| 3,792,684 | 2/1974 | Janatka et al. | 118/620 |
| 4,037,074 | 7/1977 | Montbrun et al. | 118/68 X |
| 4,081,296 | 3/1978 | Janatka et al. . | |
| 4,082,868 | 4/1978 | Schnedler et al. | 427/432 X |
| 4,154,432 | 5/1979 | Janatka et al. | 118/620 X |
| 4,321,289 | 3/1982 | Bartsch | 427/432 X |
| 4,370,357 | 1/1983 | Swartz | 118/620 X |
| 4,408,561 | 10/1983 | Yokoyama et al. | 427/432 X |
| 4,436,292 | 3/1984 | Pfannschmidt | 118/68 X |
| 4,444,814 | 4/1984 | Flinchum et al. | 118/68 X |
| 4,572,099 | 2/1986 | Michel et al. | 118/68 |
| 4,807,559 | 2/1989 | Sommer et al. | 118/620 X |
| 5,156,683 | 10/1992 | Ross | 118/620 |

FOREIGN PATENT DOCUMENTS

| | | |
|---|---|---|
| 600391 | 10/1987 | Australia . |
| B-24455/88 | 4/1989 | Australia . |
| 311602 | 5/1986 | European Pat. Off. . |
| 3231981 | 8/1986 | Germany . |
| 3821485 | 12/1989 | Germany . |

*Primary Examiner*—Carl J. Arbes

*Attorney, Agent, or Firm*—Cohen, Pontani, Lieberman & Pavane

[57] ABSTRACT

An apparatus and a process for making semi-finished products in the form of thin metal bars having a width-gauge ratio of over 60 and a maximum sheet metal gauge tolerance of 2%. A metal profile is fed continuously and upwardly through a pool of melt material having the same composition as the metal profile so as to form a coated metal profile. The metal profile is fed at a rate which would result in a coated metal profile having a thickness of at least three times that of the uncoated metal profile. The coated metal profile is subjected to a smoothing pass between a pair of smoothing rolls when the mean temperature in the crystallized layer of the coated metal profile meets a given condition. The smoothing rolls are adjustably disposed inside a housing at a distance of 0.5 to 5 m from the melt pool surface.

9 Claims, 1 Drawing Sheet

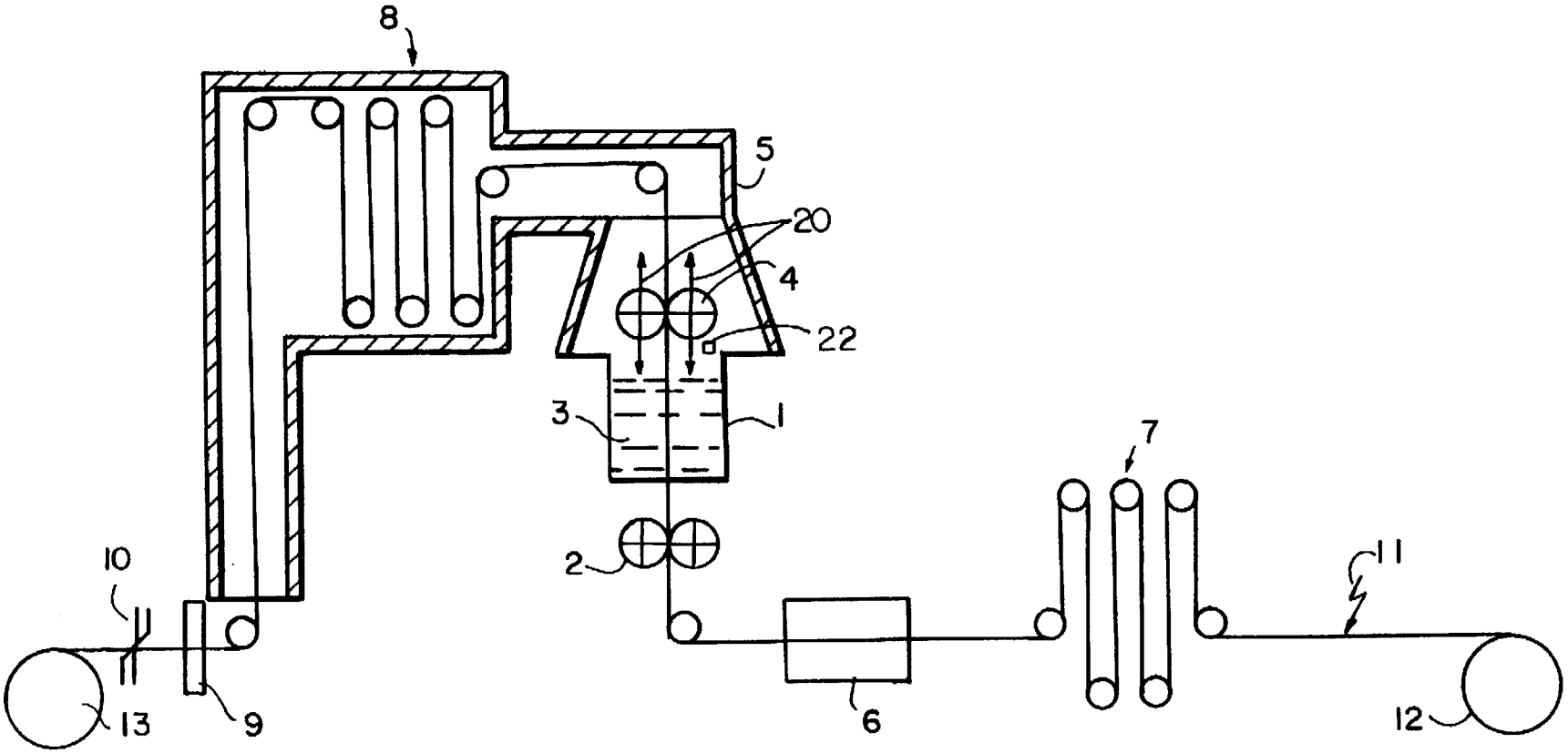
1
2
3
4
5
6
7
8
9
10
11
12
13
20
22

PROCESS FOR MAKING SEMI-FINISHED PRODUCTS

BACKGROUND OF THE INVENTION

1. Field of the Invention

The invention relates to a process and a device for making semi-finished products in the form of thin metal bars in which, an uncooled, cleaned metal profile having a low heat content is run continuously from the bottom to the top through a melt pool of material of the same composition.

2. Description of the Prior Art

A process and a device for producing thin metal bars are disclosed in EP 0 311 602 B1. A metal profile, for example, in the form of a strip-type steel sheet (blank) having a clean surface and a thickness of 0.1 to 1.4 mm, is run continuously through the bottom of a melt pool container filled with a steel melt of the same composition. For this purpose, there is a slot-type opening in the bottom of the melt container that is equipped with a sealing device for preventing the melt from flowing out. The temperature of the melt lies in the vicinity of the liquidus temperature $T_{liq}$. The steel strip moves through the melt at a constant speed and passes out of the melt upwardly. Because of the low heat content of the steel strip (strip temperature is approximately equal to room temperature), an adherent layer of crystallized and still molten melt develops on its surface. The thickness of this layer may be several times the thickness of the original blank. The thickness of the layer depends, on retention time in the melt (speed of blank), the melt temperature (temperature difference relative to the solidus temperature $T_{sol}$), the melt heat and the specific heat of the material used, and the thickness of the blank. The operation must be conducted in such a manner as to avoid remelting the already adherent crystalline like structure. Under these conditions, a temperature gradient is induced across the thickness of the strip. As the strip moves through the melt pool, the temperature is lowest in the interior of the blank and rises toward the edge. A qualitatively similar temperature curve is also present in the adherent layer. The temperature in the outermost region of the layer, is the liquidus temperature, $T_{liq}$.

Initially, the adherent layer consists of a mixture of crystalline like structure and molten melt (mushy zone). The portion of the molten phases in the layer increases in a direction toward the melt. After leaving the melt pool, blank and the adherent layer cool, whereby the temperature gradient that has existed until now is reversed. The adherent layer then solidifies completely.

From EP 0 311 602 B1 also discloses that the semi-finished product produced as described above, after it leaves the melt pool and until it cools or enters a forming machine to undergo a hot or cold forming process, is to be kept in an atmosphere for protection against oxidation. A portion of the total amount of finished product produced in this manner is then fed back to the start of the process as blank and run through the melt pool once again.

Until now, a crucial obstacle has hindered the practical application of this process in making steel strip material. Consumers of high-quality cold or hot strip demand among other things, that the range of deviation in sheet metal thickness be no greater than 2% of the nominal thickness. A tight tolerance of this kind cannot be reliably maintained using the aforementioned process. Irregularities in strip thickness which exist after the strip left the melt pool and which exceed the prescribed maximum limit are practically impossible to eliminate by means of subsequent forming procedures. This is because, given the extreme flatness of the semi-finished product used in the rolling process (width-gauge ratio of at least 60), the subsequent forming (with decreasing thickness) takes place, essentially in the longitudinal direction only; no further significant undoing occurs. Existing differences in thickness, along a line at a right angle to the longitudinal direction of the strip, therefore remain, relatively unchanged.

EP 0 311 602 B1 also describes another embodiment of the process wherein, in a reverse fashion, the blank is introduced into the melt pool from above and then drawn through the bottom of the melt vessel. The problem of sealing the bottom is particularly serious, for this embodiment because the outflow directions of the melt and the strip material are the same. As a result, not only is there no dynamic sealing effect, but there is also a negative "carry along effect" which helps induce the melt to flow out of the vessel. For this reason, a special sealing device in the form of a sealing roll pair is positioned in the bottom region of the melt vessel. This sealing roll pair causes a drastic compression of the "mushy zone", and thus large portions of the molten phase are squeezed out of the already formed "spongy" crystalline like formation. Consequently, the thickness attainable in the adherent layer, compared to the first embodiment, is considerably smaller. For economic considerations alone, such a process is unsuitable for practical applications.

SUMMARY OF THE INVENTION

An object of the invention is to further develop an apparatus and a process for making a thin metal bar having a maximum sheet-metal gauge tolerance of 2%.

In accordance with the present invention, a process for making a semi-finished, thin metal bar includes the steps of (a) feeding continuously and upwardly a metal profile through a pool of melt material of the same composition as that of the metal profile so that the metal profile is coated with an adherent layer of melt and crystalline structures; (b) setting a rate of feeding such that the coated metal profile attains a thickness of at least three times a thickness of the metal profile; (c) providing an inert atmosphere to a region where the coated metal profile exits the melt pool so as to prevent the coated metal profile from oxidizing; and (d) reducing the thickness of the coated metal profile by subjecting the coated metal profile to a smoothing pass when the adherent layer thereon attains a mean temperature, $T_{gl}$, which satisfies the following equation:

$$T_{gl}=T_{sol}+a\times(T_{liq}-T_{sol})$$

where a is a factor having a value of 0.1 to 0.8, $T_{sol}$ is a solidus temperature of the melt material, and $T_{liq}$ is a liquidus temperature of the melt material, so that the coated metal profile has a width-gauge ratio of 60 and a maximum variation in thickness of 2%.

Advantageous further developments of the invention include employing the process to make a thin metal bar having a thickness of less than 20 mm and applying factor a having a value in the range of 0.2 to 0.4. Still further developments include reducing the thickness of the coated metal proile from 5 to 15%, selecting a rate of feeding so that a ratio of the thickness of the coated metal profile to that of the metal profile lies in a range of 3 to 7, and providing a housing for enclosing a region where the coated metal profile exits from the melt pool and cooling a portion of the housing upstream the smoothing pass so as to control cooling of the coated metal profile prior to the smoothing pass. Yet further advantageous developments include cooling the portion of the housing upstream the smoothing pass to a temperature which decelerates natural convective cooling of the coated metal profile, cooling the portion of the housing upstream the smoothing pass to a temperature which accelerates natural convective cooling of the coated metal profile, and subjecting the coated metal profile to controlled cooling downstream the smoothing pass.

Another object of the invention is to provide an apparatus for making a semi-finished, thin metal bar, which includes a container for containing a pool of melt material, the container having an opening in a bottom wall shaped to accommodate passing of a metal profile therethrough. The bottom wall includes a seal disposed in the opening for continuous sealing engagement with the metal profile so as to prevent outflow of the melt material as the metal profile is fed therethrough. The apparatus further includes a transport, disposed upstream the container, for feeding the metal profile through the container and a housing, disposed over the container, for enclosing a region where the metal profile coated with a layer of melt and crystalline structures exits the melt pool. The apparatus still further includes a smoothing roll mechanism, disposed inside the housing and at a vertical distance of 0.5 to 5 m from a top surface of the melt pool, for reducing the thickness of the coated metal profile and an adjusting mechanism, operatively connected to the smoothing roll, for adjusting the vertical distance of the smoothing roll mechanism from the top surface of the melt pool. The apparatus of the present invention is suitable in principle for producing profiles of other types (e.g., round shapes or shapes with any desired polygonal cross-section).

Still another object of the invention is to provide an apparatus for making a thin metal bar of less than 20 mm in thickness. Yet another object of the invention is to provide an apparatus wherein the opening of the container is shaped like a slot so as to accommodate passage of a strip-like metal profile having a width-gauge ratio of at least 60, and the smoothing roll mechanism includes a pair of smoothing rolls spaced from each other. Still yet another object of the invention is to provide an electromechanical or hydraulic mechanism for the adjusting mechanism. Still further object of the invention is to provide an apparatus wherein the housing includes thermal insulation for insulating a portion of the housing disposed proximate the smoothing roll mechanism. Yet further object of the invention is to provide liquid cooling mechanism to the housing. Still yet further object of the invention is to provide a temperature sensor, disposed proximate the smoothing roll mechanism, for measuring a surface temperature of the coated metal profile.

BRIEF DESCRIPTION OF THE DRAWING

The invention is explained in more detail below in reference to an embodiment of the invention illustrated schematically in the drawing.

DETAILED DESCRIPTION OF THE PRESENTLY PREFERRED EMBODIMENTS

A metal coil 12, which is unwound at a particular speed, is used as a blank. Reference number 11 denotes a strip welding unit which connects the end of an already unwound coil to the new coil 12, so that the process can be carried out continuously. Reference number 7 indicates a strip storage unit which can collect a brief stoppage of the strip feed during the welding procedure in the event of a coil change, so that the production process is not interrupted. A strip cleaning device 6, which metically cleans the surface of the blank, is located downstream the strip storage unit 7 in the production stream. A transport roll pair 2 ensures that the blank, which has a width-gauge ratio of at least 60, preferably at least 100, is fed into the melt 3 at a constant preselected speed through a suitable slot-type opening in the bottom of the melt container 1. The blank has a very low heat content, because it is at room temperature, for example. The melt 3 (e.g., steel) consists of the same material as the blank. A seal located on the bottom of the melt container 1 is not shown separately in the drawing. As the blank passes upwardly through the melt 3 from the bottom to the top, a layer crystallizes on the surface of the blank. The thickness of the layer increases as the retention time increases (i.e., as the surface of the melt pool is approached), because the blank absorbs heat from its immediate surrounding in the melt 3. Otherwise, the melt 3 is kept at a temperature of, for example, 10 degrees K (Kelvin) above the liquidus temperature. By means of a feed not shown, the level of the melt pool surface is kept constant. Taking into account of these and other parameters (especially the solidus temperature, melt heat, and specific heat of the melt material), the strip speed is preferably set through the transport rolls 2 so that, upon leaving the melt 3, the blank and the adherent layer attains a thickness that is three to seven times that of the original blank.

Dispose above the melt pool surface, is a smoothing roll device in the form of a smoothing roll pair 4 positioned adjacent one another. The distance of this smoothing roll pair 4 from the melt pool surface can be changed by adjusting the vertical position of the smoothing roll pair 4, for example, by means of an electromechanical or hydraulic adjustment mechanism, which is indicated by the arrow 20 in the drawing. The minimum distance of the smoothing roll pair 4 from the melt pool surface is approximately 0.5 m and the maximum distance is 5 m. The vertical position is selected in such a way that the smoothing pass occurs at a location where the layer adhering to the blank is relatively solidified, but nonetheless still has adequate proportions of molten phase in its outer region, which would permit a free flow of material even at a right angle to the longitudinal direction of the blank. What is important, therefore, is to achieve the best possible component ratio of solid phase to liquid phase. The mean temperature in the crystallized layer can be used as a control variable for this purpose. According to the invention, smoothing is to be carried out at a temperature $T_{gl}$ which satisfies the following equation:

$$T_{gl}=T_{sol}+a\times(T_{liq}-T_{sol})$$

Where $T_{gl}$ is the mean temperature of the crystallized layer, $T_{sol}$ is the solidus temperature of the melt material and $T_{liq}$ is the liquidus temperature of the melt material, and a is a factor in the value range of 0.1–0.8, preferably in the range 0.2–0.4. The lower the value of a is, the greater the solidified portion. The lower limit sets a critical threshold because, total or almost total solidification can occur, in the layer therefore making it almost impossible to offset any large variations in strip thickness which might exist. The upper limit of the value a is determined primarily by economic considerations. Due to the high proportion of molten phase, a considerable portion would be squeezed out in the downward direction due to the vertical travel of the strip material, so that output would be correspondingly reduced. To facilitate adjustment, a strip surface temperature measurement device (22) can be provided in the adjustment area of the smoothing roll pair 4. The smoothing roll pair 4 is advantageously provided with internal liquid cooling (e.g., water cooling). The desired reduction in metal strip thickness during the smoothing pass should be in the range of 5 to 15%.

In order to avoid oxidation of the strip surface, which interferes with the further processing of the semi-finished product, the adherent layer on the blank can be protected against the influx of oxygen by a housing 5, flooded with an inert gas. The housing 5 attaches directly to the melt container 1 and houses the smoothing roll pair 4. In order to prevent desired rapid cooling of the adherent layer and excessively complete solidification this would cause, it is possible to equip portions of the walls of the housing 4 with thermal insulation as necessary, particularly in the adjustment zone of the smoothing roll device 4. Apart from this, it is useful to design the walls of the housing 5 as cooling walls, that are particularly as walls liquid-cooled from the inside (e.g., water cooling). By controlling the coolant temperature, it then becomes possible to carry out controlled cooling of the semi-finished product in the cooling zone 8 downstream the smoothing roll device 4, so that the product attains in especially favorable material properties. As in the case of continuous annealing, the strip like material is run in loops in a middle section of the cooling zone 8 by means of appropriate deflector rolls, so as to lengthen the time the strip-like material is retained in this zone. After the metal strip undergoes sufficient cooling, it leaves the housing 5 having the inert atmosphere and can, for example, be oiled by an electrostatic oiling device 9 for protection against corrosion. The material is then wound continuously into a coil 13. The coil 13, after reaching a certain weight, is separated from the rest of the strip by means of a shears 10 and transported away for further processing in a hot or cold rolling mill.

Of course, as was disclosed in EP 0 311 602 B1, it is also possible for the further processing to follow immediately. In this case, it is possible to discountinue cooling, as needed, temperature far above room temperature in order to save heat energy, and the housing with the inert atmosphere can be extended up to the attached forming machine.

The invention is described in greater detail in the following example, wherein reference is made to the Example;

A cold strip of an X60 steel containing 0.16% C;

0.35% Si;

1.30% Mn;

0.013% P;

0.003% S;

0.041% Al;

0.025% Nb;

0.0092% N;

Remainder: iron and common impurities.

The strip had a thickness of 0.5 mm and a width of 1000 mm and, after being degreased in a pickling bath 6, it was transported vertically through the bottom of a melt vessel 1 filled with molten steel using the transport roll pair 2. The melt had an analysis simulator comparable to that of the steel strip described above. Molten steel was fed continuously into the melt vessel 1 from a distributor (not shown). The level of the melt pool 3 and the speed of the steel strip are the control variables for setting the desired contact time between the steel strip and the melt pool 3. The contact time in the present case was approximately 2 sec. Because the strip speed was 1 m/s, a melt pool level of 2 m was maintained continually. During the passage of the steel strip through the steel melt 3, having a temperature of approximately 1512° C., a crystallization layer having an overall thickness of approximately 2.5 mm developed, so that the total thickness of the steel strip upon leaving the steel melt 3 was approximately 3 mm. In accordance with the formula $T=T_{sol}+a\times(T_{liq}-T_{sol})$ (here a=0.5, selected), this steel strip having a "pasty" surface (two phases: melt and crystal) was then, at a mean temperature of T=1497° C.+0.5×(1507° C.−1497° C.)=1502° C. in the deposited layer, introduced into the vertically adjustable smoothing mill 4, located in a housing 5 which was cooled in a controlled fashion and filled with, for example, argon. The maximum thickness of the steel strip was thereby reduced by approximately 17% (0.5 mm) and its surface roughness was for the most part removed. In order to attain the desired objective under the existing conditions, an integral temperature of 1502° C. proved to be especially favorable for carrying out the smoothing pass according to the invention. The smoothing device 4 was set in a vertical position such that this temperature existed on the entrance side of the smoothing mill under the given cooling conditions. The smoothing pass which was carried out resulted in a steel strip that was completely cavity-free and optimally welded in its lamination and had a uniform thickness of approximately 2.5 mm. The deviation of the actual strip thickness from the target strip thickness was, only 1.6%, clearly below the maximum permissible tolerance of 2% for hot strip which will be further processed cold. After leaving the smoothing mill 4, the steel strip, was protected against oxidation by an argon atmosphere, and subjected to controlled cooling in the water-cooled dome of the housing 4 and, after passing through a similarly cooled buffer area (cooling zone 8) filled with argon, was fed to a winding station 13. After this, the steel strip was rolled out again in a cold mill (not shown) to a thickness of 0.5 mm. The cold strip produced in this manner had outstanding metallurgical and mechanical properties and met all quality requirements. Approximately 20% of the continuously produced quantity of steel strip was fed back to the process as starting material.

The present invention makes it possible to produce, in a surprisingly simple manner, a strip-type metal bar which is extraordinarily accurate with respect to its form and surface tolerance (deviation in shape and thickness is less than 2% over the length of the strip). At the same time, this process ensures continuously reliable bonding of the adherent layer to the blank. The option of controlled cooling permits a strip material to attain excellent material properties be attained.

We claim:

1. A process for making a semi-finished, thin metal bar having a thickness of less than 20 mm, comprising the steps of:

(a) feeding continuously and upwardly a metal profile through a pool of melt material of the same composition as that of the metal profile so that the metal profile is coated with an adherent layer of melt and crystalline structures;

(b) setting a rate of feeding such that the coated metal profile attains a thickness of at least three times a thickness of the metal profile;

(c) providing an inert atmosphere to a region where the coated metal profile exits the melt pool so as to prevent the coated metal profile from oxidizing; and (d) reducing the thickness of the coated metal profile by subjecting the coated metal profile to a smoothing pass when the adherent layer thereon attains a mean temperature, $T_{gl}$, which satisfies the following equation:

$$T_{gl}=T_{sol}+a\times(T_{liq}-T_{sol})$$

where a is a factor having a value of 0.1 to 0.8, $T_{sol}$ is a solidus temperature of the melt material, and $T_{liq}$ is a liquidus temperature of the melt material, so that the coated metal profile has a width-gauge ratio of 60 and a maximum variation in thickness of 2%.

2. The process of claim 1, wherein said thin metal bar has a thickness of less than 20 mm.

3. The process of claim 1, wherein the factor a has a value of 0.2 to 0.4.

4. The process of claim 1, wherein step (d) the thickness of the coated metal profile is reduced from 5 to 15%.

5. The process of claim 1, wherein step (b) the rate of feeding is selected so that a ratio of the thickness of the coated metal profile to that of the metal profile lies in a range of 3 to 7.

6. The process of claim 1, prior to step (d), further comprising the steps of providing a housing for enclosing a region where the coated metal profile exits from the melt pool and cooling a portion of the housing upstream the smoothing pass so as to control cooling of the coated metal profile prior to the smoothing pass.

7. The process of claim 6, wherein the portion of the housing upstream the smoothing pass is cooled to a temperature which decelerates natural convective cooling of the coated metal profile.

8. The process of claim 6, wherein the portion of the housing upstream the smoothing pass is cooled to a temperature which accelerates natural convective cooling of the coated metal profile.

9. The process of claim 1, further comprising the step of subjecting the coated metal profile to controlled cooling downstream the smoothing pass.

* * * * *